United States Patent [19]

Crites et al.

[11] Patent Number: 4,467,584

[45] Date of Patent: Aug. 28, 1984

[54] METHOD AND APPARATUS FOR ATTACHING FURRING TO COLUMNS

[75] Inventors: Robert C. Crites, P.O. Box 513, Euless, Tex. 76039; Wilbur R. Youngs, Allen, Tex.

[73] Assignee: Robert C. Crites, Euless, Tex. ; a part interest

[21] Appl. No.: 355,703

[22] Filed: Mar. 8, 1982

[51] Int. Cl.[3] ..... E04C 3/30

[52] U.S. Cl. ..... 52/727; 52/489

[58] Field of Search ..... 52/727, 256, 357, 489, 52/724, 725, 715, 718, 288; 248/228, 231

[56] References Cited

U.S. PATENT DOCUMENTS

| | | | |
|---|---|---|---|
| 1,675,226 | 6/1928 | Munroe et al. . | |
| 2,089,941 | 8/1937 | Burson . | |
| 2,724,960 | 11/1955 | Nelsson | 52/712 |
| 2,924,090 | 2/1960 | Schneller | 52/712 |
| 3,333,379 | 8/1967 | Harris . | |
| 3,362,120 | 1/1968 | Warren . | |
| 3,413,775 | 12/1968 | Katz | 52/727 |
| 3,570,376 | 3/1971 | Overton et al. | 52/727 X |
| 3,748,815 | 7/1973 | Parker | 52/727 X |
| 3,897,669 | 8/1975 | Uydess . | |
| 3,998,028 | 12/1976 | Pelletien | 52/727 |

FOREIGN PATENT DOCUMENTS

| | | | |
|---|---|---|---|
| 2917551 | 11/1979 | Fed. Rep. of Germany | 52/727 |
| 1186867 | 4/1970 | United Kingdom | 52/727 |
| 773218 | 10/1980 | U.S.S.R. | 52/727 |

*Primary Examiner*—J. Karl Bell

*Attorney, Agent, or Firm*—Richards, Harris & Medlock

[57] ABSTRACT

A system for attaching furring to a column includes a corner clip (20) with a first portion (30) having a pair of notches (36, 38) therein and a second portion (40, 42) at an angle to the first portion. A band (22) encircles the column and bands the second portion of the clips to the column at spaced distances along the column. A corner angle (60) has inturned tips (62, 64) which are engaged into the notches of at least two of the clips spaced along the column. Furring is then attached to the corner angles to cover the column.

14 Claims, 7 Drawing Figures

METHOD AND APPARATUS FOR ATTACHING FURRING TO COLUMNS

TECHNICAL FIELD

The present invention relates to a method and apparatus for attaching furring to columns and similar structures. The invention uses a unique corner clip which makes the process faster and less expensive while providing improved support for the furring.

BACKGROUND ART

In many instances, it is desirable to cover structural columns used in building construction. Covering of columns may be for one of several reasons, including protection of the columns in the event of fire or merely to provide a decorative surface over the column. Where the covering serves as a heat shield, it takes the place of more expensive fire proofing such as manual plastering or applying a similar coating directly to the column.

Although several prior methods and structures have been used to attach gypsum board and other similar materials to columns, these prior systems have required the use of considerable materials and time. One of the most common methods of attachment uses a hat section rail which is attached at the edges of each of the sides of the column along the longitudinal length thereof. These hat section rail strips are fastened to the column by nails which are driven by an explosive charge or "shot" through the hat section rails and into the column. This technique requires two hat section rails at each corner which run the full length of the column. As many as sixty shots are required to fasten the rails to the column. Additionally, because of the design of the hat section rails, no support is provided by the hat section rails immediately behind the gypsum board at the very corner defined by the covering.

The resilient furring channel shown in U.S. Pat. No. 3,333,379 to D. A. Harris, issued Aug. 1, 1967, illustrates one type of hat section rail which has been used. The more common hat section rail found in use is a solid rail not having the openings in the upstanding leg as shown in the furring channel disclosed in the Harris patent.

Other devices have been used for attaching furring to various structural components. For example, the patent to Uydess, U.S. Pat. No. 3,897,669, issued Aug. 5, 1975, discloses a clip for securing plasterboard to I-beam girder. This device would not be usable in attaching gypsum board, or the like, to columns.

DISCLOSURE OF THE INVENTION

The present invention provides a method and apparatus for attaching gypsum board, wallboard and the like to structural columns which are less expensive, both in cost of components and labor required, than the prior art. The present invention further provides support immediately behind the gypsum board or other covering at the very corner of these coverings, thus providing a more sturdy and stable finished structure. The present invention also provides a method and apparatus which eliminate the need for two rails at each corner and provide for a more expedititious manner of attaching covering structure to the column.

In accordance with one embodiment of the invention, the structure for attaching furring to a column includes a corner clip with a first portion having a pair of spaced notches therein and a second portion extending from the first portion at an angle thereto. A band encircles the column and engages the second portion of the clip to attach it to the column. The clips are attached at spaced distances along the column. A corner angle is engaged into the notches in the corner clip using at least two of the clips spaced along the column. Gypsum board, particle board or the like is then attached to the corner angles with appropriate fasteners.

In a more specific embodiment of the invention, the first portion of the corner clip has a pair of legs in an L-shaped configuration with the second portion of the clip including a leg extending from each leg of the first portion. The legs of the second portion of the clip are at right angles to the first portion and lie in planes substantially perpendicular to each other. The corner angle comprises an angle having inturned end tips for snap engagement into the slots of the corner clip. The slots in the corner clip are aligned substantially at right angles to each other.

In an alternative embodiment, the present invention may also be practiced using a clip having a substantially rectangular first portion with a notch therein and a second portion extending at an angle from the first portion for engagement to the column. Two of the fittings are attached, such as by banding, to the column at spaced points along the column and adjacent to one corner. A corner angle is attached to the clips by engaging one inturned end tip of the angle into the notch in the spaced corner clips with the other inturned end tip of the angle being engaged between the second portion of the corner clip and the column.

BRIEF DESCRIPTION OF THE DRAWINGS

For a more complete understanding of the present invention, and for further details and advantages thereof, reference is now made to the following Detailed Description taken in conjunction with the accompanying Drawings, in which.

DETAILED DESCRIPTION

Figure 1:
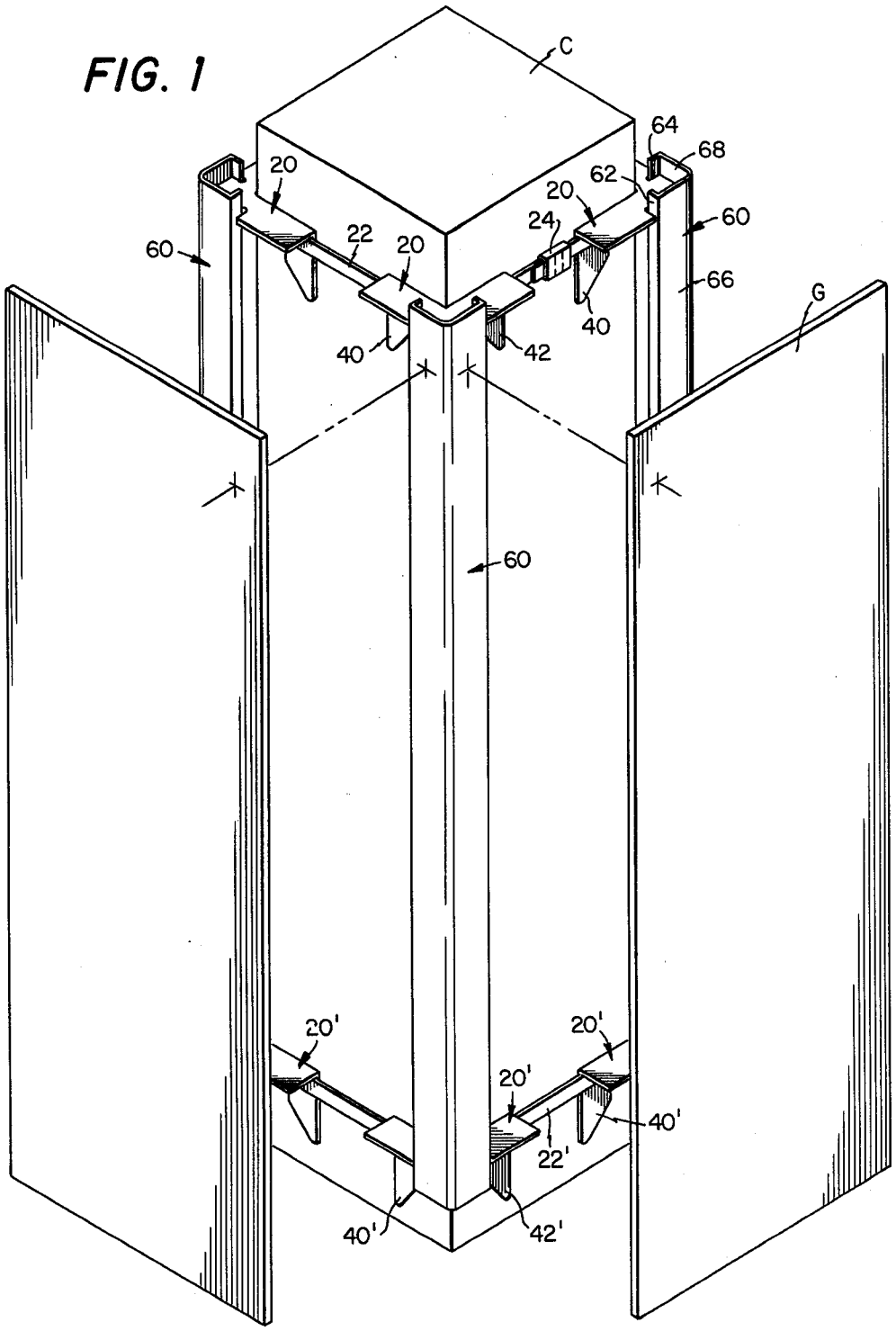
FIG. 1 is a perspective view showing the present invention for attaching a furring to a column with the furring exploded away from the attachment structure for clarity.

Referring to FIG. 1, the structure of the present invention for attaching furring to a column includes four identical corner clips 20 attached to the column C by a band 22 encircling the column for engaging a portion of clip 20 to the column. Band 22 is joined at its ends by an appropriate crimp fitting 24.

Figure 2:
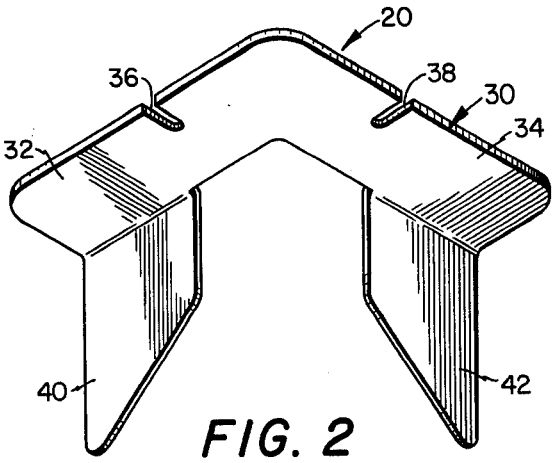
FIG. 2 is a perspective view showing the corner clip used in the present invention.

As is best seen in FIGS. 1 and 2, corner clip 20 includes a planar L-shaped upper portion 30 consisting of legs 32 and 34. A notch 36 is formed in leg 32 and a similar notch 38 is formed in leg 34. Legs 32 and 34 are at right angles to one another as are notches 36 and 38. The leg portion of clip 20 includes a downwardly extending leg 40 formed at a right angle to leg 32 and a similar downwardly extending leg 42 formed at a right angle to leg 34.

It will be appreciated that clip 20 may easily and inexpensively be made from a single piece of flat stock having equal side dimensions. Manufacture can be accomplished by rounding the corners of the square section of material, cutting notches 36 and 38 to the removing a square blank from the center of the section. A diagonal cut is then made from the corner opposite the corner between notches 36 and 38 to the blank and legs 40 and 42 are bent at right angles to legs 32 and 34, respectively. It will be understood that clip 20 may be made in any number of ways, including die casting. Of course, several methods of structure are contemplated, each of which is considered to come within the scope of the present invention.

Referring specifically to FIG. 1, a second attachment structure, identical to that shown near the upper portion of column C, is attached at a point along the column structure spaced from the first attachment structure. Thus, corner clips 20' are attached to column C using a band 22' to engage downwardly extending legs 40' and 42' to the column.

Figure 3:
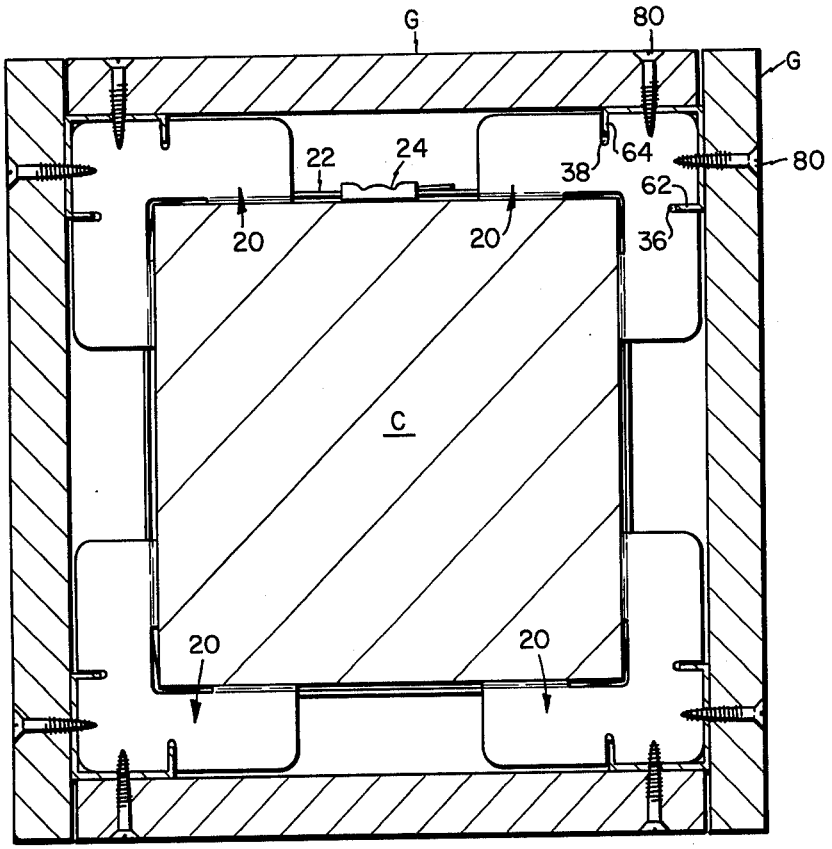
FIG. 3 is a section view as it would appear taken on FIG. 1 with the furring attached to the column.

A corner angle 60 is attached adjacent the corner of column C by engagement of inturned end tips 62 and 64 into notches 36 and 38, respectively. This engagement is also shown in the section view illustrated in FIG. 3. Corner angle 60 includes legs 66 and 68 from which inturned end tips 62 and 64 extend, respectively. The outwardly extending surfaces of legs 66 and 68 are knurled as is shown in FIG. 1 to facilitate driving of screws therethrough as will be discussed hereinafter in greater detail.

Figure 4:
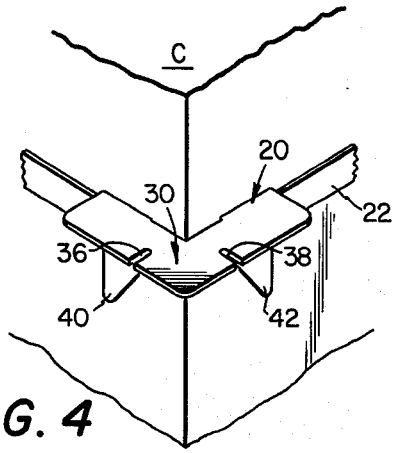
FIGS. 4, 5 and 6 illustrate the steps of construction for the present invention.
Figure 5:
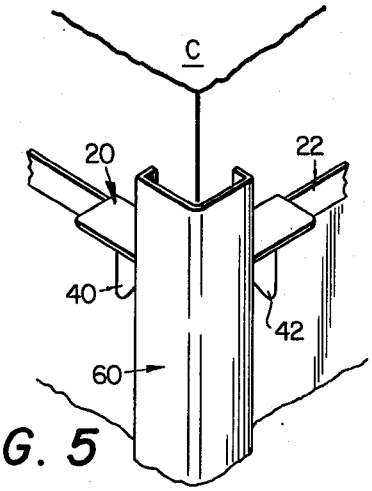
Figure 6:
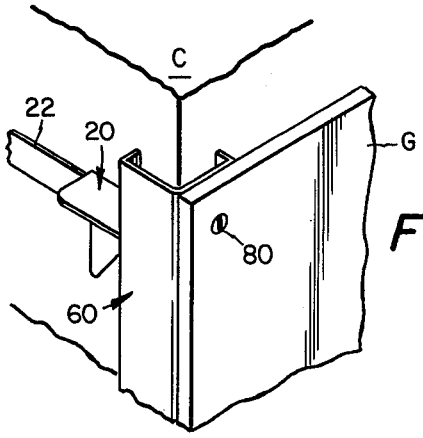

The method of use of the present invention is illustrated in the sequence of FIGS. 4–6. FIG. 4 shows clip 20 being attached to column C by band 22. This step is quickly and easily achieved by placing one of the clips 20 at each corner of the column, encircling the column with band 22 with downwardly extending legs 40 and 42 of clip 20 engaged between band 22 and column C. Tension is drawn on band 22 and the band is tied off by using a standard crimp fitting as is well known in the art. With fitting 24 attached to the column, as is shown in FIG. 4, notches 36 and 38 are positioned away from the column as shown. Corner angle 60 is then easily snapped into place with inturned end tips 62 and 64 engaging notches 36 and 38 of corner clip 20. It will be understood that corner angle 60 is sufficiently flexible such that one inturned end tip may be engaged into its corresponding notch with the other end tip being snapped into its respective notch by merely applying a slight force to the corner angle. Once in its snapped position, the angle is securely in place positioned at an appropriate distance from column C over its entire length. As is shown in FIG. 6, gypsum board, wallboard or other covering is then attached directly to corner angle 60 by the use of appropriate screws 80. Knurling the faces of corner angle 60 facilitates the engagement of screws 80 through gypsum board G into the angle.

Any number of screws may be used along the length of the gypsum board with any desired spacing. As can readily be seen in FIG. 3, the present invention provides a support structure, namely, corner angle 60, at the immediate corner of the column. Unlike the prior art hat rail sections, no support at the immediate corner beneath the gypsum board is provided. As can also be appreciated by viewing FIG. 3, once all four sides are attached to the column, the structure is integrally attached such that even the release of band 22 will not effect the attachment of the furring to the column.

Although the invention as illustrated and described with respect to FIGS. 1–6 has taught the attachment of clip 20 to column C using a band, it will, of course, be appreciated by those skilled in the art that other means of attachment of clip 20 to column C may be used. For example, clip 20 may be attached using fasteners, adhesive or other alternative methods. All of these methods are contemplated and are intended to be within the scope of the present invention.

Figure 7:
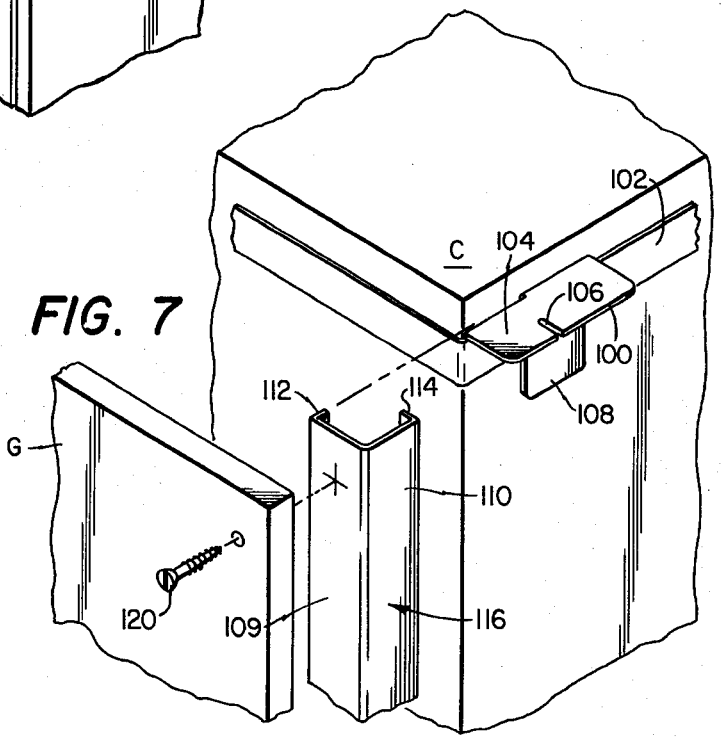
FIG. 7 shows an alternative form of the present invention.

FIG. 7 illustrates an alternative embodiment of the present invention which permits the gypsum board or other covering to be placed adjacent to at least one surface of the column upon assembly. In this arrangement, a clip 100 is attached to column C using a band 102. Clip 100 includes an upper portion 104 having a notch 106 therein. A leg 108 extends downwardly and at right angles from upper portion 104. Lower leg 108 is secured to column C by band 102. In this way, upper portion 104 of clip 100 extends at right angles from the side wall of column C as shown. A corner angle 116 includes legs 108 and 110 with inturned end tips 112 and 114, respectively, extending therefrom.

As in the primary embodiment illustrated in FIG. 1, a clip similar to that shown in FIG. 7 is also attached to the column at a spaced point adjacent the corner of the column. Corner angle 116 is then engaged onto clip 100. This is accomplished by sliding inturned end tip 112 between band 102 and upper portion 104 of clip 100 and snapping inturned end tip 114 into notch 106. Then, an appropriate gypsum board G is attached to corner angle 116 by appropriate fasteners 120. As will be appreciated, attachment can be made using any number of fasteners 120 at any position along the length of corner angle 116. The other faces of the column may then be covered using similar covering boards which are secured in the same way to corner angle 116.

Thus, the present invention provides a means for attaching furring to a column which saves time and expense, both in the cost of the attachment structure and the cost of labor. The system of the present invention incorporates structure which provides a corner angle, positioned at an appropriate distance from the column at each corner of the column. In this way, gypsum board or similar covering material may be attached to the corner angle by using standard fasteners to complete the furring of the column. Once assembled, the furring is locked in place to provide a very secure covering.

While the present invention has been described as it might be used to cover a column, it will be appreciated that the present invention might also be used to cover any outside corner surface. In such an arrangement, the corner clips would be attached to the corner by any suitable means, such as fasteners or adhesives. To these corner clips, the corner angles would be attached and the covering fastened thereto. Thus, the present invention is not to be limited to its mere application to the covering of columns.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

We claim:

1. A system for attaching furring to a column comprising:

a corner clip with a first portion having a pair of spaced notches therein and a second portion extending from the first portion at an angle thereto;

a band for encircling the column and banding the clips to the column at spaced distances along the column, said band engaging the second portion of said clips to the column; and a corner angle for engagement into the notches in at least two of said clips spaced along the column, said corner angles serving to receive fasteners therein for holding furring thereto to cover the column.

2. The system according to claim 1 wherein said second portion of said clip is at right angles to said first portion.

3. The system according to claim 1 wherein the first portion of said clip has a pair of legs in an L-shaped configuration for engagement at the corner of the column, and wherein said second portion comprises a leg extending from each leg of said first portion, said legs of said second portion lying in planes substantially perpendicular to each other and arranged to engage adjoining walls of the column to align the fitting such that the legs of the first portion of said clip extend substantially perpendicularly from the walls of the column.

4. The system according to claim 3 wherein said notches comprise a slot in each of the first portion, said slots being substantially at right angles to each other.

5. The system according to claim 1 wherein said corner angle comprises an angle having inturned end tips for engagement into said notches 6. A clip for use in attaching furring to a column comprising:

a fitting having a first portion comprising a pair of legs in an L-shaped configuration with one edge for engagement with said column at a corner thereof, said first portion further having a notch therein, a second portion extending at an angle from the first portion for flat engagement against the wall of the column; and said notch defined such that a furring receiving angle may be retained by the use of two of said fittings positioned at a spaced relationship on the column.

7. The clip according to claim 6 wherein said first portion has a notch in each leg thereof for receiving the angle therein.

8. The clip according to claim 6 wherein said second portion comprises a leg extending from each leg of said first portion, said second portion legs lying in planes substantially perpendicular to each other.

9. The clip according to claim 8 wherein said notches comprise a slot in each leg of the first portion, said slots being substantially at right angles to each other.

10. A method for attaching furring to a column comprising:

attaching a corner clip adjacent each corner of the column using a band encircling the column, said clip including a first portion having a pair of spaced notches therein and a second portion extending from the first portion at an angle thereto, said second portion of the corner clip being engaged between the band and the column surface;

attaching a second group of corner clips adjacent each corner of the column but at a spaced distance from said first clips using a band encircling the column, said second clips each having a first portion with a pair of spaced notches therein and a second portion extending from the first portion at an angle thereto said second portion of the corner clips being engaged between the band and the column surface;

attaching a corner angle adjacent each corner of the column by engaging a portion of the corner angle into the notches of the first and second corner clips; and attaching a furring to the corner angles to cover the column.

11. The method according to claim 10 wherein the corner angles comprises an angle having inturned end tips for engagement into the slots of the corner clips, thereby permitting the corner angles to be snapped into the slots and retained therein without fastening means.

12. The method according to claim 10 wherein said step of attaching said corner clip to the column includes attaching a band around the column with the second portion of each corner clip engaged between the band and the column; and applying an appropriate tension to the band and clamping the band to retain the clips in engagement with the column.

13. A clip system for use in attaching furring to a column comprising:

a fitting having a first portion with a pair of legs in an L-shaped configuration with the inside edge of said L-shaped configuration for engagement at the corner of the column and a second portion extending at an angle from the first portion for flat engagement against said one wall of the column, wherein said second portion comprises a leg extending from each leg of said first portion, said legs of said second portion lying in planes substantially perpendicular to each other and arranged to engage adjoining walls of the column to align the fitting such that the legs of the first portion of said fitting extend substantially perpendicularly from the walls of the column;

means for attaching the second portion of said fitting to said column; and a furring receiving angle for attachment to the first portion of said fittings.

14. The system according to claim 13 wherein said second portion of said fitting is at right angles to said first portion.

* * * * *